US006076744A

United States Patent [19]

O'Brien

[11] Patent Number: 6,076,744

[45] Date of Patent: Jun. 20, 2000

[54] FULL CONE SPRAY NOZZLE

[75] Inventor: Michael S. O'Brien, Algonquin, Ill.

[73] Assignee: Spraying Systems Co., Wheaton, Ill.

[21] Appl. No.: 09/219,978

[22] Filed: Dec. 23, 1998

[51] Int. Cl.[7] ..... B05B 1/34; B05B 15/02

[52] U.S. Cl. ..... 239/110; 239/487; 239/491

[58] Field of Search ..... 239/487, 491, 239/390, 104, 106, 110

[56] References Cited

U.S. PATENT DOCUMENTS

| | | | |
|---|---|---|---|
| 2,765,197 | 10/1956 | Chimbole | 239/110 |
| 2,898,036 | 8/1959 | Newell | 239/110 |
| 2,999,648 | 4/1961 | Wahlin et al. | 239/487 |
| 3,666,183 | 5/1972 | Smith | 239/487 X |
| 4,014,470 | 3/1977 | Burnham | 239/487 X |

FOREIGN PATENT DOCUMENTS

| | | | |
|---|---|---|---|
| 3439193 | 4/1986 | Germany | 239/110 |
| 197708 | 8/1977 | U.S.S.R. | 239/407 |

*Primary Examiner*—Kevin Weldon
*Attorney, Agent, or Firm*—Leydig, Voit & Mayer, Ltd.

[57] ABSTRACT

A full cone spray nozzle having a vane which comprises a plurality of vane segments each disposed in a respective quadrant of a vane chamber and formed with respective flat ramp surfaces and concave surfaces which divide the incoming liquid into two flow streams and impart vortical and turbulent movement to the liquid such that the liquid discharged from the nozzle has a conical spray pattern with liquid particles distributed throughout the spray pattern. The vane chamber is formed with outwardly extended recesses adjacent and across from concave surfaces of the vane segments for ensuring maximum free tangential passage of solids through the vane without affecting the liquid flow rate. In one embodiment the recesses are in the form of slots in a cylindrical mounting ring of the vane segments and in another embodiment the recesses are outwardly extending grooves in a cylindrical wall of the nozzle body which defines the vane chamber.

38 Claims, 4 Drawing Sheets

FULL CONE SPRAY NOZZLE

FIELD OF THE INVENTION

The present invention relates generally to full cone spray nozzles, and more particularly, to spray nozzle assemblies having a vane structure for imparting swirling and turbulent motion to liquid passing through the nozzle to produce a conical spray pattern with liquid particles distributed throughout the discharging conical pattern.

BACKGROUND OF THE INVENTION

Spray nozzles of the foregoing type have been known for many years, but have been problem prone. Such spray nozzles, for example, commonly are used for spraying slurries or like liquids containing solid phase materials which may be restricted by the swirl passageways defined by the vane. While it is desirable to design the vanes of such whirl spray nozzles for maximum free passage, namely with passageways that will permit passage of solid balls, corresponding in diameter to the final discharge orifice of the nozzle, problems in the vane design remain. For example, if the nozzle body and/or vane structure is a cast part, variations in casting tolerances can adversely effect the maximum free passage of the nozzle. Efforts to increase the size of the vane passageways to compensate for such tolerances can adversely effect the desired flow rate of the nozzle. Furthermore, while it is desired that the discharging spray distribute liquid particles in substantially uniform fashion through out the conical spray pattern, prior spray nozzles with such whirl and turbulent parting vanes can create spray patterns with uneven liquid distribution or with flutter, i.e., the angle of the cone being unsteady and varying during spray operations. Moreover, flutter problems become more pronounced as the angle of the conical spray pattern becomes wider.

OBJECTS AND SUMMARY OF THE INVENTION

It is an object of the present invention to provide a full cone spray nozzle assembly with an improved vane structure for imparting vortical and turbulent movement in the passing liquid.

Another object is to provide a spray nozzle assembly as characterized above in which the maximum free solids passage is maintained notwithstanding variances in manufacturing tolerances.

A further object is to provide a spray nozzle assembly of the foregoing type that is operable for providing more uniform liquid distribution throughout the discharging spray cone.

Still another object is to provide a spray nozzle assembly of the above kind that is effective for directing a substantially flutter free conical spray pattern.

Yet another object is to provide such a spray nozzle assembly that is of relatively simple construction and which lends itself to economical manufacture and reliable operation.

Other objects and advantages of the invention will become apparent upon reading the following detailed description and upon reference to the drawings, in which:

Figure 1:
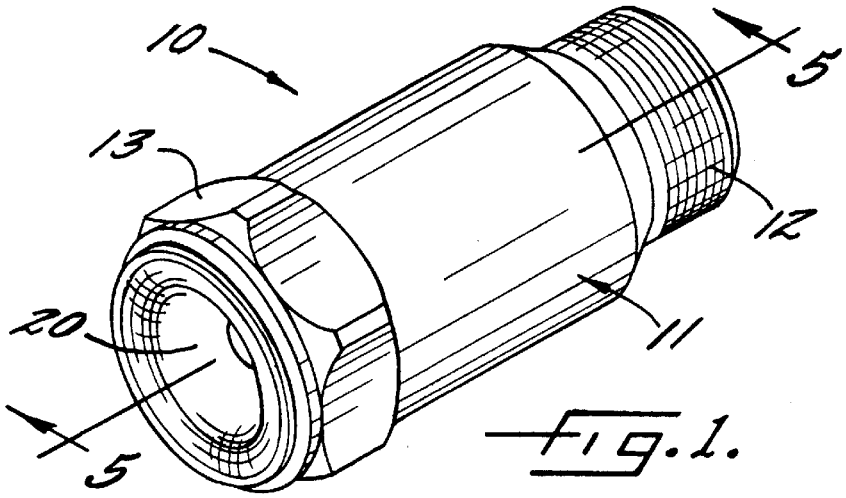
FIG. 1 is a perspective of a spray nozzle assembly in accordance with the present invention.
Figure 2:
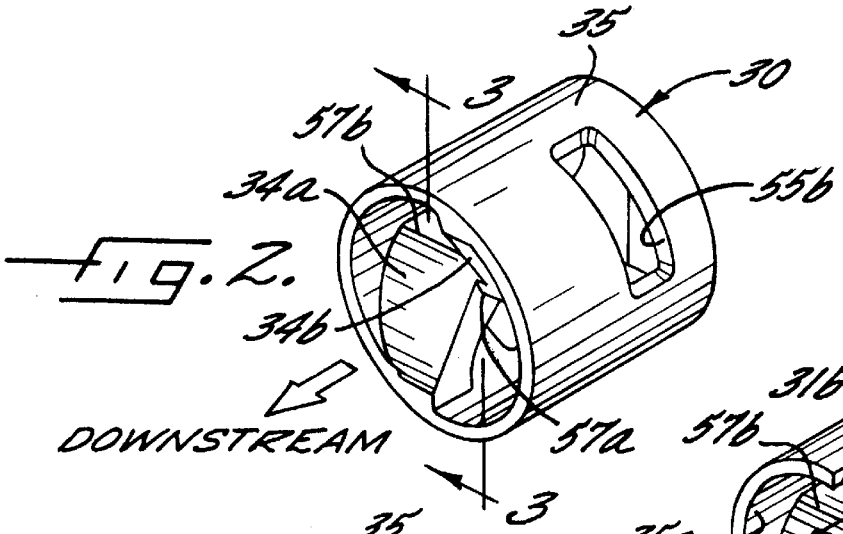
FIG. 2 is a perspective of the vane included in the spray nozzle assembly shown in FIG. 1, viewed from a downstream end thereof.
Figure 3:
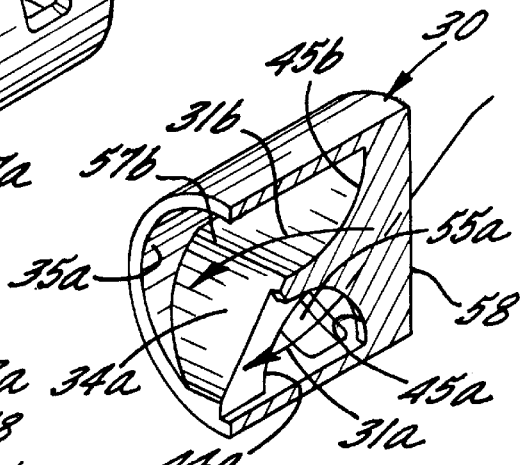
FIG. 3 is a vertical section of the vane, taken in the plane of line 3—3 in FIG. 2.
Figure 4:
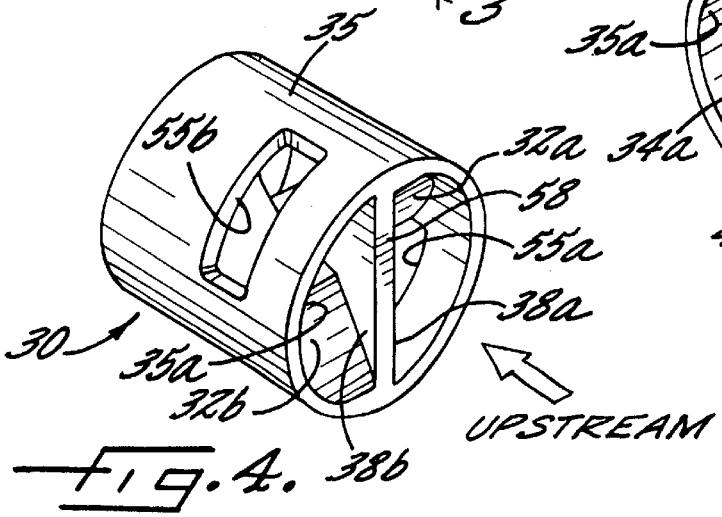
FIG. 4 is a perspective of the illustrated vane, viewed from an upstream end.

While the invention is susceptible of various modifications and alternative constructions, certain illustrated embodiments thereof have been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIGS. 1–9 of the drawings, there is shown an illustrative spray nozzle assembly 10 embodying the invention.

The spray nozzle assembly 10 comprises an elongated hollow body 11 having an externally threaded neck 12 for connection to a suitable fluid supply line 12*a* and a hex head 13 at its opposite downstream end. The neck 12 has an inlet passage 14 communicating with an enlarged diameter, cylindrical vane chamber 15 through a frusto conical entry portion 16. The vane chamber 15 communicates with a whirl chamber 18, which in turn communicates with a discharge orifice 20 of the nozzle assembly through an inwardly tapered frusto conical section 21. The whirl chamber 18, in this instance, is slightly smaller in diameter and shorter in length than the vane chamber 15. The discharge orifice 20 has a radiused annular side wall for defining a full cone spray pattern, which in the illustrated embodiment has a discharge angle $\alpha$ of about 120 degrees.

The illustrated nozzle body 11 has a two part construction comprising an outer shell 22 which defines the inlet 14 and vane chamber 15 and a separate orifice insert 24 which defines the whirl chamber 18 and discharge orifice 20 and is telescopically positioned within a downstream end of the shell 22. The orifice insert 24 is disposed against a shoulder 25 of the shell 22 defined by an insert receiving counterbore 26 and is secured in mounted position by a downstream lip 28 of the shell 22 which is coined over a tapered downstream end portion 29 of the orifice insert 24.

For imparting swirling and turbulent motion to liquid passing from the inlet 14 to the whirl chamber 18, a vane 30 is telescopically housed within the vane chamber 15. The vane 30 in this case is disposed in seated engagement between an end of the orifice insert 24 and the tapered entry portion 16 of the shell 22. The vane 30 defines a pair of generally helical passages 31*a*, 31*b* for imparting swirling vortical movement to the liquid.

In accordance with the invention, the vane has a uniquely constructed one-piece configuration for ensuring maximum free passage of solids and imparting turbulent movement to the passing liquid that enhances ultimate substantially uniform liquid particle distribution in a stable conical discharging spray pattern. To this end, the illustrated vane 30, which preferably has a one-piece cast metal construction, includes four vane segments, 32*a*, 32*b*, and 34*a*, 34*b*, each disposed within a respective quadrant of the vane chamber 15. The vane 30 in this case has an outer cylindrical ring 35 within which the segments 32*a*, 32*b*, 34*a*, 34*b* are integrally formed, and an inner side wall 35*a* of the mounting ring 35 defines the effective diameter of the vane chamber 15 through which the liquid flow streams are directed. The segments 32*a*, 32*b*, are disposed in diametrically opposed quadrants adjacent an upstream end of the cylindrical mounting ring 35, and segments 34*a*, 34*b*, are disposed in diametrically opposed quadrants adjacent a downstream end of the mounting ring 35. The segments 32*a*, 34*a*, furthermore, are disposed on one diametric longitudinal side of the vane chamber, and the segments 32*b*, 34*b* are disposed in an opposite diametric longitudinal side of the whirl chamber. In other words, the segments 32*a*, 34*a* are separated from the segments 32*b*, 34*b* by a diametric plane passing through the longitudinal axis of the vane.

In keeping with the invention, the upstream segments 32*a*, 32*b* each are formed with substantially flat ramp surface 36*a*, 36*b* on an upstream side thereof which, in conjunction with the cylindrical mounting ring 35, define inlets to the respective flow passages 31*a*, 31*b*. Each flat ramp surface 36*a*, 36*b* is generally pie shaped, one side 38*a*, 38*b* of which is in a radial plane through the axis of the vane, another other side of which is defined by the cylindrical wall 35*a* of the mounting ring 35, and the third side 40*a*, 40*b* of which is at a downstream end of the ramp surface 36*a*, 36*b* in a radial plane perpendicular to the plane of the first side 38. The ramp surfaces 36*a*, 36*b* each are disposed at an acute angle θ of at least 45° to the longitudinal axis of the vane, and alternatively may be disposed at acute angles up to about 60° to the vane axis. The ramp surfaces 36*a*, 36*b* guide incoming liquid into the vane passages 31*a*, 31*b* in a generally axial direction.

Each ramp surface 36*a*, 36*b* extends to a respective concave, radiused surface 44*a*, 44*b* formed on upstream sides of the segments 34*a*, 34*b*, which again are disposed in diametrically opposed relation to each other. For imparting tangential movement to the flow streams directed through the vane flow passage 31*a*, 31*b*, the concave surfaces 44*a*, 44*b* have partial cylindrical configurations with their axes of curvature perpendicular to the vane axis and parallel to the planes of the respective upstream ramp surfaces 36*a*, 36*b*. The concave surfaces 44*a*, 44*b* preferably have a radius of about one-half the diameter of the vane defined by an inner cylindrical surface 35*a* of the cylindrical mounting ring 35.

For enabling maximum free passage of solids through the vane passages 31*a*, 31*b*, the downstream or undersides of the segments 32*a*, 32*b* which define the ramp surfaces 36*a*, 36*b* are formed with concave, radiused surfaces 45*a*, 45*b*. The concave surfaces 45*a*, 45*b* are again partially cylindrical in form and preferably have the same radius as the concave surfaces 44*a*, 44*b* with the axes of the curvature parallel to the axis of curvature in the concave surfaces 44*a*, 44*b*. In the illustrated embodiment, the downstream or underside surfaces of the segments 34*a*, 34*b* which define the concave surfaces 44*a*, 44*b* are formed with flat ramp surfaces 51*a*, 51*b* similar to the lead in ramp surfaces 36*a*, 36*b* of the segments 32*a*, 32*b*, but oppositely inclined.

Figures 5, 6, 7:
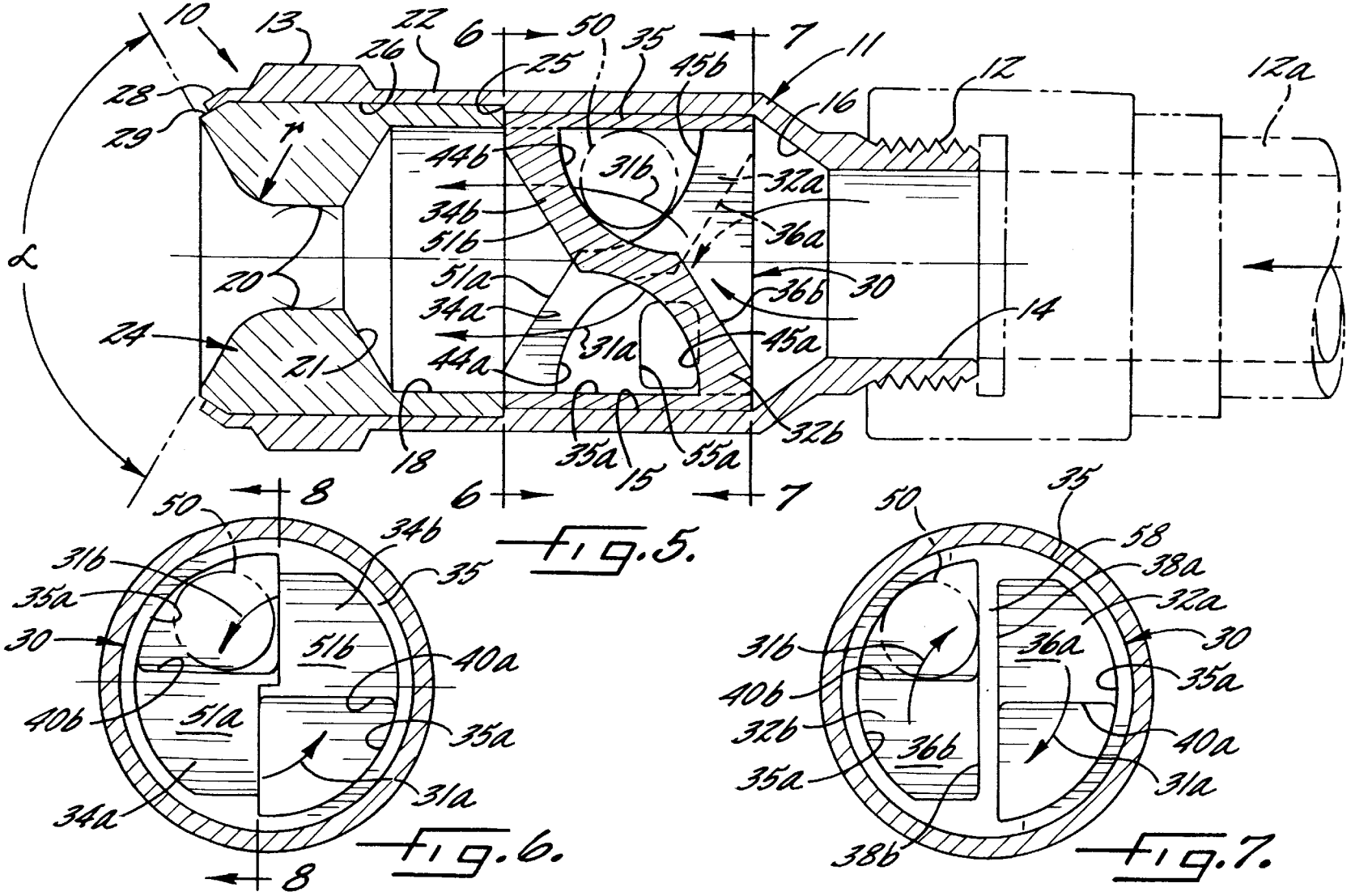
FIG. 5 is an enlarged longitudinal section of the vane, taken in the plane of line 5—5 in FIG. 1.
FIGS. 6 and 7 are vertical sections taken in the planes of lines 6—6 and 7—7, respectively, in FIG. 5.
Figure 8:
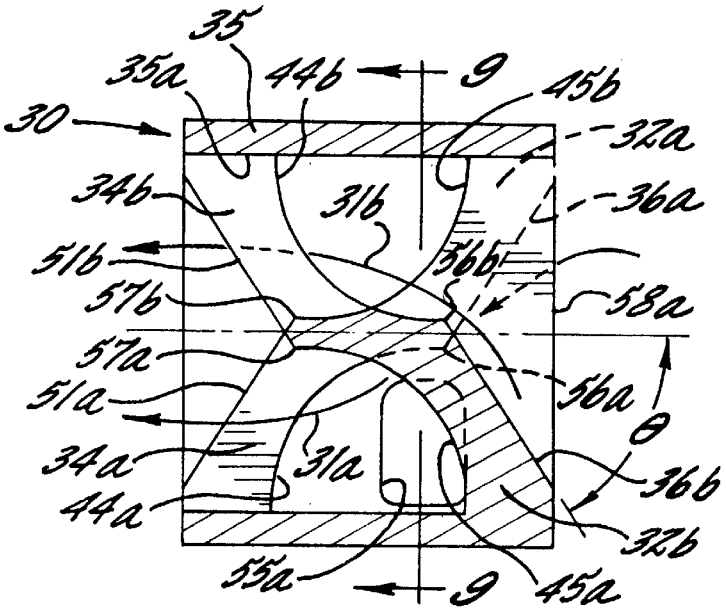
FIG. 8 is a longitudinal section of the vane, taken in the plane of line 8—8 in FIG. 6.
Figure 9:
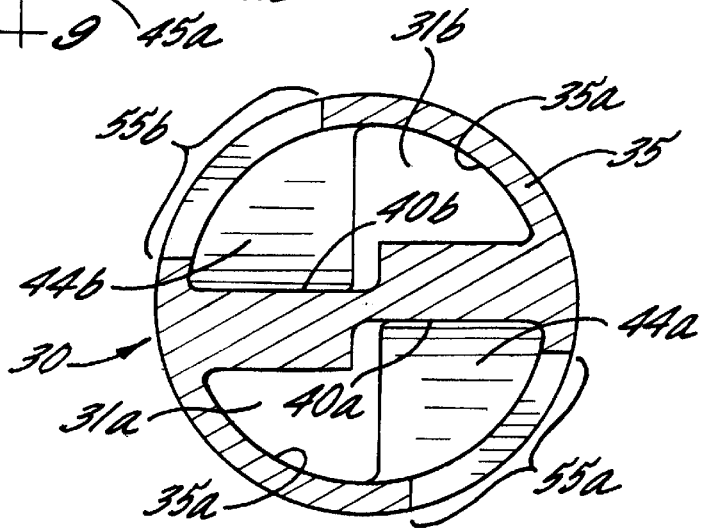
FIG. 9 is a vertical section of the vane, taken in the plane of line 9—9 in FIG. 8.

As will be appreciated by one skilled in the art, the design of the vane will enable maximum free passage of balls 50 corresponding in diameter to the diameter of the discharge orifice 20 of the nozzle. As depicted by phantom lines in FIGS. 5–7, solid balls 50 can enter the flow passages 3*a*, 31*b* in the diagrammatically opposed quadrants of the vane at upstream ends of the ramps 36*a*, 36*b* and be guided by the ramp surfaces 36*a*, 36*b* and the cylindrical side wall 35*a* of the mounting ring 35 in an axial downstream direction. Upon reaching the concave surfaces 44*a*, 44*b*, of the vane segments 34*a*, 34*b* the balls are tangentially directed through the passageway defined by the concave surfaces 44*a*, 44*b*, concave surfaces 45*a*, 45*b*, and the cylindrical wall 35*a* of the mounting cylinder 35. The cylindrical wall 35*a* continues to tangentially direct the flow stream (i.e. balls 50) as they exit the vane 30, as depicted in FIG. 6, along the flat ramp surfaces 5*a*, 51*b* defined by the downstream or undersides of the diametrically opposed segments 34*a*, 34*b*.

In accordance with an important aspect of the invention, to ensure maximum free passage of solids corresponding in size to the discharge orifice of the nozzle not withstanding variances in manufacturing tolerances, the vane passages 3*a*, 31*b* are relieved at the most constricted or critical locations, while not altering the liquid flow rate through the vane and nozzle. In the illustrated embodiment, the vane liquid flow passages 3*a*, 31*b* are relieved by forming diametrically opposed slots 55*a*, 55*b* through the side wall 35*a* of the mounting ring 35. The slots 55*a* in this case are substantially rectangular in configuration and are disposed through diametrically opposed quadrants of the mounting ring 35 adjacent and across from the upstream ends of the concave surfaces 44*a*, 44*b*, of the segments 32*a*, 32*b*. By reason of the reliefs defined by the slots 55*a*, 55*b* at such critical flow passage locations, notwithstanding manufacturing tolerances or slight defects in manufacture, free passage of maximum size solids through the vane passages 3*a*, 31*b* is not impeded. Since the relieved areas defined by the slots 55*a*, 55*b* do not increase the effective cross-sectional areas of flow passageways 31*a*, 31*b*, it will be understood by one skilled in the art that the flow rate through the nozzle remains unaffected.

Not only does the unique configuration of the diametrically opposed segments 32*a*, 32*b*, 34*a*, 34*b* of the vane 30 permit maximum free passage of solids, but the combination of the ramp and radiused surfaces of the segments has been found to both impart swirling or vortical movement to the liquids passing through the vane passages and enhance turbulence and liquid break down into particles which can ultimately be directed from the is nozzle discharge orifice in a substantially uniform liquid spray pattern. To this end, in the illustrated embodiment, the ramp surfaces 36*a*, 36*b*, 51*a*, 51*b* and concave surfaces 44*a*, 44*b*, 45*a*, 45*b* further define relatively sharp radial corners or edges 56*a*, 56*b*, and 57*a*, 57*b* at their lines of juncture on both upstream and downstream sides of the segments, which enhance liquid breakdown and turbulence as it passes through the vane passages 31*a*, 3*b*.

In carrying out a further feature of the invention, the vane 30 has an axial partition in the form of a diametric wall 58 at its upstream end, which separates the vane segments 32*a*, 32*b* and facilitates division of incoming liquid into the respective flow passages 31*a*, 31*b* for creating a more balanced flow condition through the nozzle, particularly during start-up conditions, and for minimizing and preventing flutter in the discharging conical spray pattern. The diametric wall 58 in this instance extends upwardly from the radial sides 38*a*, 38*b* of the ramp surfaces 36*a*, 36*b* and has an upstream end 58*a* coincident with the upstream end of the mounting cylinder 35. The partition 58 has been unexpectedly found to stabilize the discharging spray pattern, such that the perimeter of the spray pattern maintains a well-defined conical shape. In practice, a spray nozzle 10 having a vane 30 of the foregoing type has been found to have exceptionally good performance in terms of uniform particle distribution and conical spray pattern stability when the orifice 20 is designed to discharge spray at conical angles a of between about 120 and about 90 degrees. To produce smaller conical spray patterns, the radiused annular wall that defines the discharge orifice 20 must be made with a smaller radius Y, as known in the art, which tends to reduce surface tension of liquid as the liquid proceeds along the annular surface defining the discharge orifice. This proportionally smaller radiused surface projects the liquid in a more uniform conical spray distribution pattern. This distribution characteristic is achieved with the proportionally smaller radiused surfaace, due to reduced surface tension effects. Nozzles of this type made with a larger radiused surface produced a spray pattern with a heavy distribution of liquid on the outer ring of the cone with a light distribution in the center.

Figure 10:
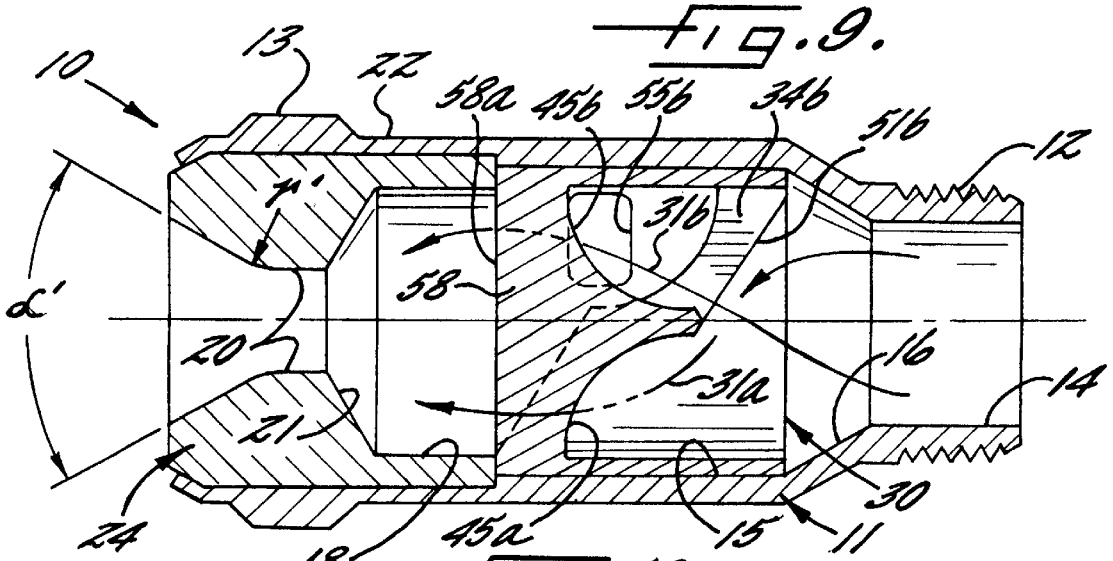
FIG. 10 is a vertical section of an alternative embodiment of the invention, with the vane mounted in longitudinally reversed orientation from that shown in FIG. 5.

In accordance with a further feature of the invention, for spray nozzles in which the conical spray angle θ' is less than about 90 degrees, the vane 30 is assembled in the nozzle body in reverse orientation, as depicted in FIG. 10, with the diametric wall or petition 58 at the downstream end. In such condition, the vane 30 unexpectedly enhances the uniform distribution of liquid throughout the spray pattern and reduces flutter and instability in the discharging spray. While the theory of operation is not entirely understood, the diametric wall or petition 58 is believed to create additional drag on the liquid as it leaves the vane, slowing down the swirling action sufficient to agitate the liquid so that it will more completely discharge throughout the spray pattern.

Figure 11:
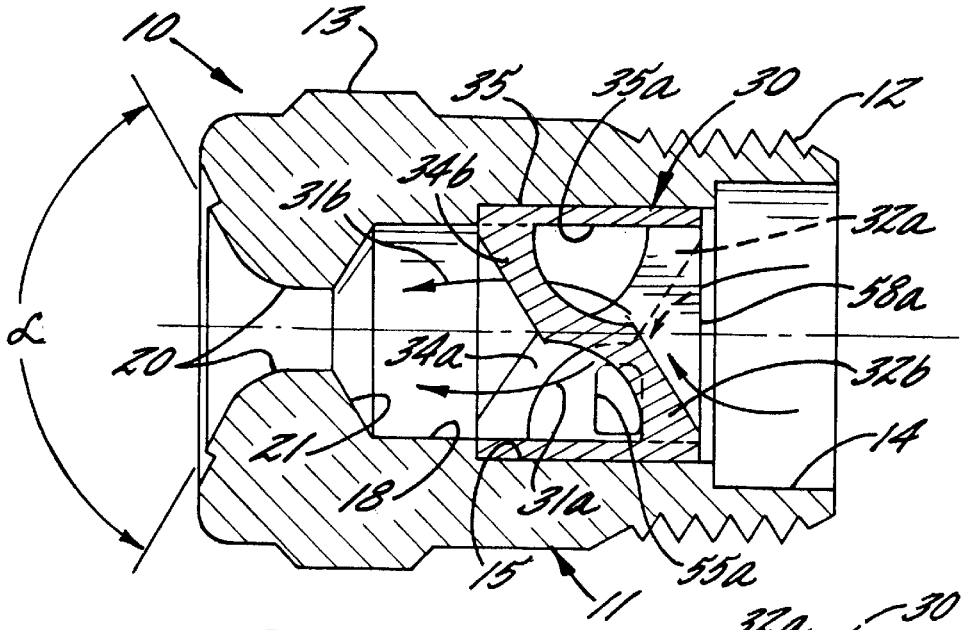
FIG. 11 is a vertical section of an alternative embodiment of spray nozzle assembly according to present invention.

While in the embodiment shown in FIGS. 1–10, the nozzle body 11 is shown to have a two part construction, it will be understood by one skilled in the art that the nozzle "body" may be integrally formed, as depicted in FIG. 11. In this case, the vane 30 is disposed in a cylindrical vane chamber 15 with the end thereof abutting a shoulder defined by the smaller diameter whirl chamber 18. In this embodiment, the effective diameter of the vane 30, as defined by the inner cylindrical wall 35*a* of the vane mounting ring 35, is substantially the same as the diameter of the whirl chamber. Again, the slots 55*a*, 55*b* (of which only the slot 55*a* is visible) in the side wall 35*a* of the mounting cylinder 35 define relief areas to ensure that the maximum flow passage is maintained, notwithstanding tolerances or slight manufacturing defects, without interfering with the flow rate of the nozzle.

Figure 12:
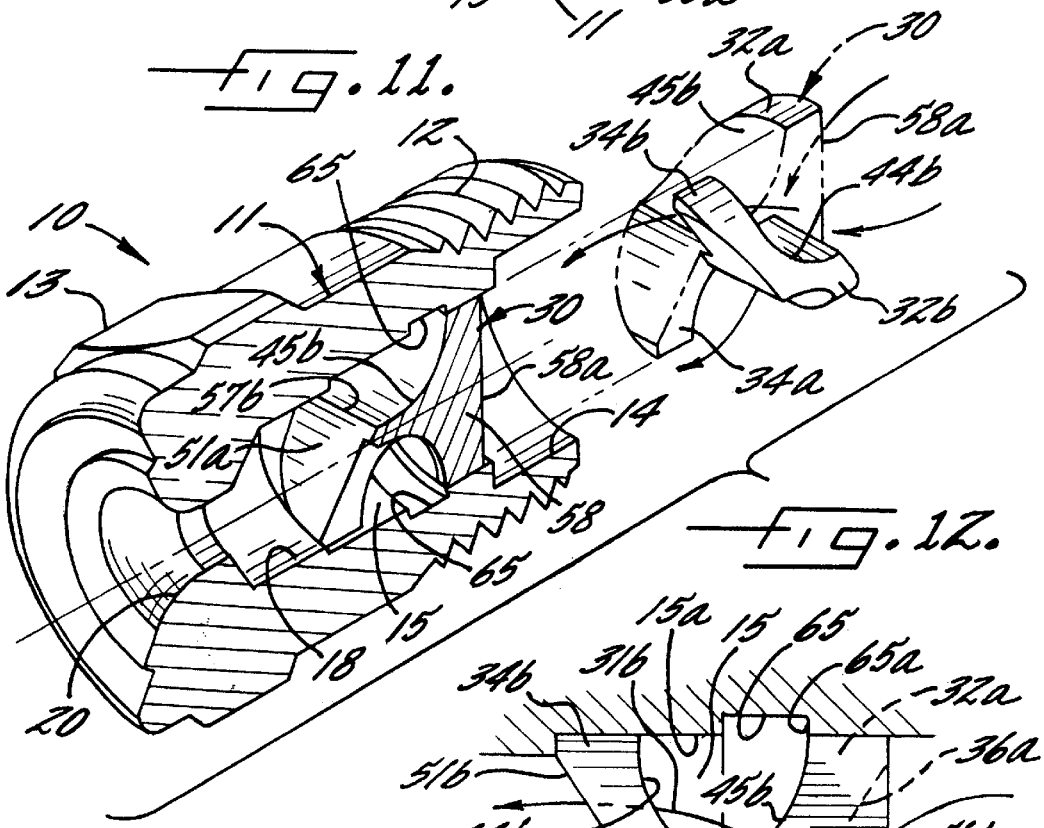
FIG. 12 is an exploded view of the spray nozzle assembly shown in FIG. 11.
Figure 13:
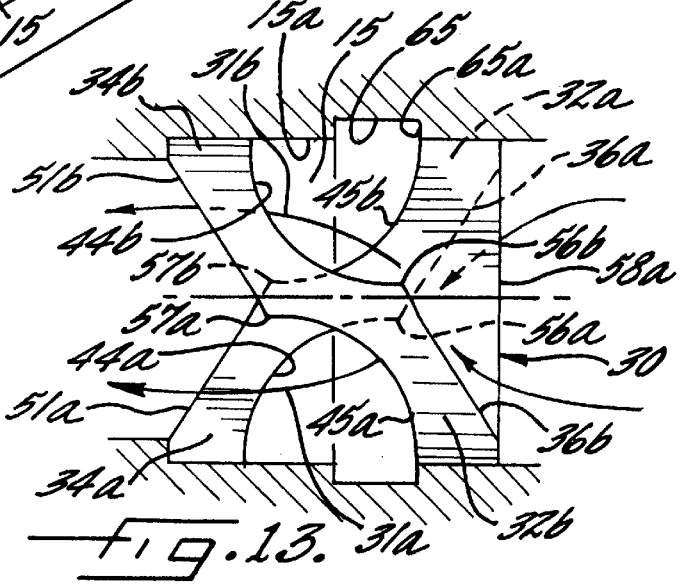
FIG. 13 is an enlarged longitudinal section of the vane and housing shown in FIG. 11.

Referring now more particularly to FIGS. 12–13, there is shown an alternative embodiment of nozzle having a vane pursuant to the invention, which preferably is machined from bar stock, wherein items similar to those described above have been given similar reference numerals. The nozzle 10 has a one-piece body 11 having an upstream end formed with external threads 12 for connection to an appropriate liquid supply line. The nozzle body 11 has a longitudinal flow passageway defined by a cylindrical inlet passage 14, a vane chamber 15, a downstream whirl chamber 18, and a discharge orifice 20 communicating with the whirl chamber 18. A vane 30 is press fit within the vane chamber 15 for imparting vortical and turbulent motion for liquid passing through the nozzle and for directing said liquid with swirling motion into the whirl chamber 18.

In carrying out the invention, the vane 30 is substantially similar in form to the vane described in connection with the embodiment of FIGS. 1–7 but without the outer mounting ring. The vane 30 similarly comprises four segments, 32*a*, 32*b*, 34*a* and 34*b* disposed in respective quadrants of the vane chamber 15 with the downstream segments 34*a*, 34*b* being connected in longitudinal relation to the upstream segments 32*a*, 32*b*, respectively.

In keeping with the invention, the upstream segments 32*a*, 32*b* are formed with flat inlet ramp surfaces 36*a*, 36*b*, inclined to the longitudinal vane axis, which together with a cylindrical side wall 15*a* of the vane chamber 15 guide and longitudinally direct liquid onto the downstream segments 34*a*, 34*b*. The downstream segments 34*a*, 34*b* are formed with respective concave surfaces 44*a*, 44*b*, which together with the cylindrical side 15*a* all of the vane cavity turn the fluid in a tangential direction while creating turbulence and break up of the flow stream.

To facilitate maximum free passage of solids, the undersides or downstream sides of the ramps are formed with concave curved surfaces 45*a*, 45*b*, which together with the concave surfaces 44*a*, 44*b* of the downstream segments 34*a*, 34*b*, define generally annular flow passages for the longitudinally and tangentially directed flow streams. For guiding and directing liquid tangentially into the whirl chamber 18, the downstream or undersides of the segments 34*a*, 34*b* are formed with flat ramp surfaces 51*a*, 51*b*, inclined to the vane axis oppositely to the inlet ramp surfaces 36*a*, 36*b*.

To facilitate liquid breakup, the flat ramp surfaces 36*a*, 36*b*, and concave surfaces 44*a*, 44*b* define respective sharp comers or edges 56*a*, 56*b* along the line of joinder. The underside ramp surfaces 51*a* 52*b* and concave surfaces 45*a*, 45*b* similarly are joined by a sharp comers or edges 57*a*, 57*b*. To facilitate direction of the liquid flow stream as it passes through the vane 30 and to stabilize the discharging spray, the vane 30 has an axial partition wall 58 extending upstream of radial sides of the ramp surfaces 36*a*, 36*b* diametrically across the vane. The partition 58 has an upstream end 58*a* coincidence with the upstream end of the vane 30. It will be understood by one skilled in the art that the vane 30 and its ramp surfaces and concave surfaces can be easily produced by standard machining procedures.

In keeping with the invention, in order to enable maximum free passage of solids through the vane, notwithstanding variations or defects in manufacturing processing, the vane chamber 15 is relieved in a radial direction at the most critical locations, namely at locations where the fluid flow stream and solids are being turned and directed tangentially. In the illustrated embodiment as shown in FIGS. 12–13, the nozzle body 11 is formed with a circumferential undercut or relief grooves 65 which extend radially outwardly from the diameter of the cylindrical wall 15*a* of the vane chamber 15 within which the vane is mounted. The grooves 65, which define outwardly extending recesses, are disposed at diametrically opposed locations adjacent and across upstream ends of the concave surfaces 45*a*, 45*b*. As explained with respect to the embodiments of FIGS. 1–9, the grooves 65 effectively insure maximum free passage of solids at critical passage points in the vane 30, while not altering the flow characteristics of the liquid flow stream.

From the foregoing, it can be seen that the nozzle of the present invention has a uniquely configured one-piece vane structure that ensures maximum free passage of solids and imparts turbulent movement to the passing liquid in a manner that enhances ultimate substantially uniform particle distribution in a stable conical discharging spray pattern. The nozzle and vane structure, furthermore, are relatively simple in construction and lend themselves to economical manufacture and reliable operation.

What is claimed is:

1. A full cone spray nozzle comprising:

a nozzle body, a liquid flow passage through said body defined by an inlet in said body, a vane chamber downstream of said inlet, a whirl chamber downstream of the vane chamber, and a discharge orifice, a vane disposed within said vane chamber for imparting vortical and turbulent movement in a liquid flow stream passing through said vane and into said whirl chamber, said vane including a pair of segments disposed in different quadrants of said vane chamber, said segments defining an upstream flat entry ramp surface and a downstream concave surface such that a liquid flow stream passing through said vane is directed by said flat entry ramp surface in a downstream axial direction onto said concave surface which tangentially directs the liquid flow stream and creates turbulence and liquid is break down such that liquid emitted from said discharge orifice has a conical shaped spray pattern with liquid particles distributed through the spray pattern.

2. The spray nozzle of claim 1 in which said ramp surface is disposed at an acute angle of at least 45 degrees to a longitudinal axis of said vane, and said concave surface has a partial cylindrical configuration with an axis of curvature perpendicular to the vane axis and parallel to the plane of the ramp surface.

3. The spray nozzle of claim 1 in which the concave surface has a radius of curvature of about one-half the diameter of half the vane.

4. The spray nozzle of claim 1 in which said flat ramp and concave surface join each other to define a sharp edge.

5. The spray nozzle of claim 1 in which said segments are disposed within a mounting cylinder.

6. The spray nozzle of claim 5 in which said segments and mounting cylinder are integrally formed.

7. The spray nozzle of claim 5 in which an inner wall of said mounting cylinder defines an effective diameter of the vane chamber and a liquid flow passage through said vane.

8. The spray nozzle of claim 1 in which the vane chamber is relieved in an outward radial direction adjacent and across from the concave surface for ensuring tangential passage of solids having a diameter at least as great as the diameter of said discharge orifice.

9. The spray nozzle of claim 8 in which said mounting cylinder is formed with at least one slot adjacent and across from said concave surface for enabling tangential passage of solids having a diameter at least as great as the diameter of said discharge orifice.

10. A full cone spray nozzle comprising:

a nozzle body, a liquid flow passage through said body defined by an inlet in said body, a vane chamber downstream of said inlet, a whirl chamber downstream of the vane chamber, and a discharge orifice, a vane disposed within said vane chamber for imparting vortical and turbulent movement in a liquid flow stream passing through said vane and into said whirl chamber, said vane including four segments each of which is disposed in a respective quadrant of said vane chamber, two of said segments each defining an upstream flat ramp surface and two of said segments each defining a concave surface, said concave surfaces each being downstream a respective one of said flat ramp surfaces such that a liquid flow stream passing through said vane is directed by said flat ramp surfaces in a downstream axial direction onto said concave surfaces which tangentially direct the liquid flow stream and create turbulence and liquid break down such that liquid emitted from said discharge orifice has a conical shaped spray pattern with liquid particles distributed throughout the spray pattern.

11. The spray nozzle of claim 10 in which two of said segments are disposed on one diametric longitudinal side of said vane chamber, and the other of said segments are disposed on an opposite diametric longitudinal side of said vane chamber.

12. The spray nozzle of claim 10 in which each of said flat ramp surfaces is generally pie-shaped having one straight side in a radial plane through the axis of said vane, another side which is curved complementary to the vane chamber, and a third straight side which is at a downstream end of said ramp surface in a radial plane perpendicular to the plane of the first side.

13. The spray nozzle of claim 10 in which said ramp surfaces each are disposed at an acute angle of at least 45 degrees to the longitudinal axis of the vane.

14. The spray nozzle of claim 10 in which said ramp surfaces each are disposed at an acute angle of about 60 degrees of the longitudinal axis of the vane.

15. The spray nozzle of claim 10 in which said flat ramp and concave surfaces join each other to define sharp edges.

16. The spray nozzle of claim 15 in which said sharp edges are radially oriented with respect to the longitudinal axis of the vane.

17. The spray nozzle of claim 10 in which said segments are disposed within a mounting cylinder.

18. The spray nozzle of claim 10 in which the vane chamber is relieved in an outward radial direction at diametrically opposed locations adjacent and across from the concave surfaces for ensuring tangential passage of solids having a diameter at least as great as the diameter of said discharge orifice.

19. The spray nozzle of claim 17 in which said mounting cylinder is formed with diametrically opposed slots adjacent and across from said concave surfaces for enabling tangential passage of solids having a diameter at least as great as the diameter of said discharge orifice.

20. A full cone spray nozzle comprising:

a nozzle body having a liquid flow passage through said body defined by an inlet in said body, a vane chamber downstream of said inlet, a whirl chamber downstream of the vane chamber, and a discharge orifice, a vane disposed within said vane chamber for imparting vortical and turbulent movement in a liquid flow stream passing through said vane and into said whirl chamber, said vane including four segments each of which is disposed in a respective quadrant of said vane chamber, said segments including two upstream segments each defining a flat entry ramp surface disposed at an angle to a longitudinal axis of said vane and two downstream segments each defining a curved surface such that liquid passing through said vane is directed by said flat ramp surfaces in a downstream axial direction onto said curved surfaces which tangentially direct and create turbulence in the liquid prior to entering said whirl chamber.

21. The spray nozzle of claim 20 in which one of said upstream segments and one of said downstream segments are disposed on one diametric longitudinal side of said vane chamber, and the other of said upstream and downstream segments are disposed on an opposite diametric longitudinal side of said vane chamber.

22. The spray nozzle of claim 20 in which said upstream segments each define a curved surface on an underside thereof which together with the curved surfaces of said downstream segments define a generally annular tangential flow passageway for liquid directed through said vane.

23. The spray nozzle of claim 22 in which said downstream segments define flat ramp surfaces on an underside thereof.

24. The spray nozzle of claim 23 in which flat ramp surfaces of said downstream segments are inclined at an acute angle to the vane axis opposite to the ramp surfaces of said upstream segments.

25. The spray nozzle of claim 20 in which said curved and ramp surfaces each join each other to form sharp edges to enhance turbulence and liquid break up of the flow stream through said vane.

26. The spray nozzle of claim 20 in which said nozzle body has a two part construction comprising a first port which defines the inlet and vane chamber and a second port which defines said whirl chamber and discharge orifice.

27. The spray nozzle of claim 26 in which said second port is an orifice insert telescopically positioned within a downstream end of said first port.

28. The spray nozzle of claim 20 in which said nozzle body has a one part integral construction.

29. The spray nozzle of claim 20 in which said vane has a wall extending diametrically across and end thereof.

30. The spray nozzle of claim 29 in which said diametric wall has an end face substantially flush with the end of said vane.

31. The spray nozzle of claim 29 in which said vane is disposed within said vane chamber with said diametric partition at an upstream end.

32. The spray nozzle of claim 29 in which said vane is disposed within said vane chamber with said diametric wall at a downstream end of said vane.

33. The spray nozzle of claim 29 in which diametric wall extends upstream from said flat ramp surfaces.

34. A conical spray nozzle comprising:

a nozzle body, a liquid flow passage through said body defined by an inlet in said body, a vane chamber downstream of said inlet, a whirl chamber downstream of the vane chamber, and a discharge orifice, a vane disposed within said vane chamber and having a diameter coinciding with the diameter of said vane chamber, said vane defining at least one liquid flow passageway that tangentially turns liquid as it passes through said vane prior to being directed into said whirl chamber, and said vane chamber being formed with a recess in an outward radial direction adjacent the vane passageway at a location at which the liquid is tangentially turned for enabling passage of solids in the liquid flow stream having a diameter at least as great as the discharge orifice without affecting the flow rate through the vane as established by the diameter of said vane chamber.

35. The spray nozzle of claim 34 in which said vane defines two liquid flow passages that each tangentially turn liquid as it passes through said vane, and said vane chamber is formed with recesses in an outward radial direction on diametrically opposed sides of the vane adjacent the vane passageways at locations at which the liquid is tangentially turned.

36. The spray nozzle of claim 35 in which said vane chamber is defined by a cylindrical wall of said nozzle body, and said recesses are outwardly extending grooves in said nozzle body wall.

37. The spray nozzle of claim 35 in which said vane includes an outer cylindrical mounting ring, and said recesses are defined by diametrically opposed slots in said mounting ring.

38. The spray nozzle of claim 37 in which said vane passages are defined by a plurality of vane segments, said segments being integrally formed within said cylindrical mounting ring.

* * * * *